United States Patent [19]

Aalto et al.

[11] Patent Number: 4,607,671

[45] Date of Patent: Aug. 26, 1986

[54] RECONSTITUTION DEVICE

[75] Inventors: William R. Aalto, Spring Grove; James L. Sertic, Lindenhurst, both of Ill.

[73] Assignee: Baxter Travenol Laboratories, Inc., Deerfield, Ill.

[21] Appl. No.: 642,908

[22] Filed: Aug. 21, 1984

[51] Int. Cl.[4] ..... B65B 3/04

[52] U.S. Cl. ..... 141/329; 141/383; 604/412; 604/413; 604/415; 604/416

[58] Field of Search ..... 141/19, 329, 330, 382, 141/383, 384, 385, 386; 604/411–416, 52

[56] References Cited

U.S. PATENT DOCUMENTS

| | | | |
|---|---|---|---|
| D. 267,199 | 12/1982 | Koenig | D24/53 |
| 2,290,677 | 7/1942 | Delaney | 141/386 |
| 3,788,369 | 1/1974 | Killinger | 141/114 |
| 3,826,260 | 7/1974 | Killinger | 128/272 |
| 3,826,261 | 7/1974 | Killinger | 128/272 |
| 3,841,329 | 10/1974 | Killinger | 128/220 |
| 3,872,867 | 3/1975 | Killinger | 128/272 |
| 3,976,073 | 8/1976 | Quick et al. | 128/272 |
| 4,328,802 | 5/1982 | Curley et al. | 128/272 |
| 4,410,321 | 10/1983 | Pearson et al. | 604/56 |
| 4,411,662 | 10/1983 | Pearson | 604/411 |
| 4,432,755 | 2/1984 | Pearson | 604/56 |
| 4,434,823 | 3/1984 | Hudspith | 141/383 |
| 4,458,733 | 7/1984 | Lyons | 141/1 |

*Primary Examiner*—Houston S. Bell, Jr.
*Attorney, Agent, or Firm*—Paul C. Flattery; John P. Kirby, Jr.; Bradford R. L. Price

[57] ABSTRACT

A reconstitution device for constituting a drug in a standard drug vial with a liquid in a second container such as a parenteral solution container is provided. The reconstitution device 10 includes a housing 52 and a hollow, double-pointed needle 54 mounted within the housing. The housing includes a sheath 70 having a substantially circular base 72 and a skirt 74 depending from the base. The skirt 72 includes a free end 76, a substantially cylindrical inner surface 78 and an outer surface 80. A plurality of inwardly projecting bumps 82 are intermittently spaced about the inner surface 78. The bumps are disposed a substantially equal distance from the base 72, the distance being substantially equal to the width of the malleable band.

14 Claims, 7 Drawing Figures

FIG. 4
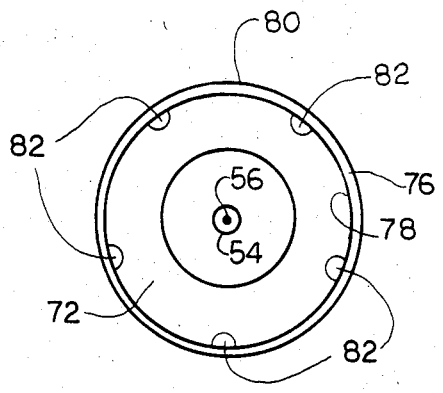
FIG. 5A
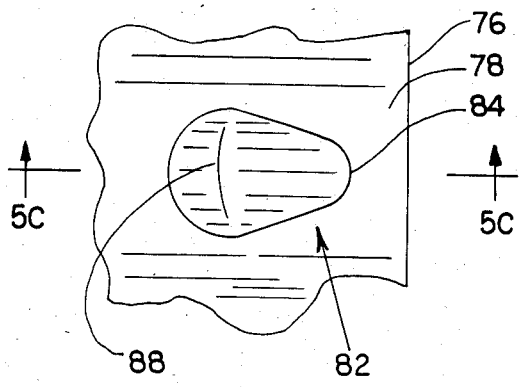
FIG. 5B
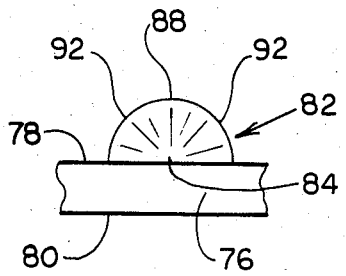
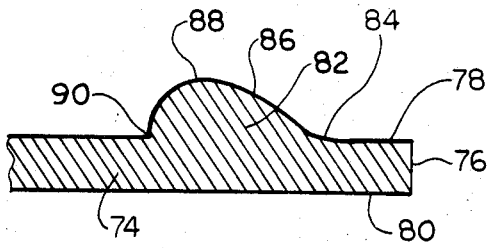
FIG. 5C

RECONSTITUTION DEVICE

FIELD OF THE INVENTION

The reconstitution device of the present invention is directed to the proper mixing of one substance with another and is particularly directed to the medical field for the reconstitution of a drug by a diluent.

BACKGROUND OF THE INVENTION

Many drugs are mixed with a diluent before being delivered intravenously to a patient. The diluent may be for example a dextrose solution, a saline solution or even water. Many such drugs are supplied in powder form and packaged in glass vials. Other drugs, such as some used in chemotherapy, are packaged in glass vials in a liquid state.

In order for powdered drugs to be given intravenously to a patient, the drugs must first be placed in liquid form. Other drugs, although in a liquid state, must be still be diluted before administration to a patient. In this specification, reconstitution also includes dilution.

One way of reconstituting a powdered drug is to first inject the liquid diluent into the drug vial. This may be performed by means of a combination syringe and syringe needle having diluent therein. After the rubber stopper of the drug vial is pierced by the needle, liquid in the syringe is injected into the vial. The vial is shaken to mix the powdered drug with the liquid. The liquid is then withdrawn back into the syringe. The steps may be repeated several times. The syringe is withdrawn. The drug may then be injected into a patient.

Another common means of drug administration is to inject the reconstituted drug in the syringe into a parenteral solution container, such as a Minibag TM flexible parenteral solution container or Viaflex ® flexible parenteral solution container sold by Travenol Laboratories of Deerfield, Ill., a wholly owned subsidiary of the assignee of the present invention. These containers may already have therein dextrose or saline solution, for example. The drug, now mixed with the solution in the parenteral solution container, is delivered through an intravenous solution administration set to a vein access site of the patient.

Another means for reconstituting a powdered drug utilizes a reconstitution device sold by Travenol Laboratories, product code No. 2B8064. That device includes a double-pointed needle and guide tubes mounted around both ends of the needle. This prior art reconstitution device is utilized to place the drug vial in flow communication with a flexible walled parenteral solution container for example. Once the connection is made, liquid in the solution container may be forced into the drug vial by squeezing the solution container. The vial is then shaken. The liquid in the vial is withdrawn by squeezing air from the solution container into the vial. When compression of the flexible-walled solution container is stopped, the pressurized air in the vial acts as a pump to force the liquid in the vial back into the solution container.

Another form of reconstitution device is seen in U.S. Pat. No. 3,976,073 to Quick et al., assigned to the assignee of the present invention. Yet another type of reconstitution system is disclosed in U.S. Pat. No. 4,328,802 to Curley et al., entitled "Wet Dry Syringe Package" which includes a vial adapter having inwardly directed retaining projections to firmly grip the retaining cap lip of a drug vial to secure the vial to the vial adapter. The package disclosed in Curley is directed to reconstituting a drug by means of a syringe.

Other means for reconstituting a drug are shown for example in U.S. Pat. Nos. 4,410,321 to Pearson et al., entitled "Closed Drug Delivery System"; 4,411,662 to Pearson and 4,432,755 to Pearson, both entitled "Sterile Coupling;" and 4,458,733 to Lyons, entitled "Mixing Apparatus", all assigned to the assignee of the present invention.

There has become associated with the reconstitution of a powder or liquid drug in a drug vial with the liquid in a separate parenteral solution container an increasingly frequent and significant problem. That problem is that a greater number of drugs are dangerous and are hazardous to hospital personnel. Such drugs include many chemotherapy drugs. Additionally, it is believed that some other drugs are hazardous upon repeated exposures over time.

Use of any reconstitution means which uses separate drug and diluent containers will likely result in exposure of personnel to the drug. A common source of exposure is small volumes of the drug/diluent mixture which may drip from the needle utilized to reconstitute the drug. This problem is also becoming increasingly common in doctors' offices as well as hospitals because drug reconstitution, especially with chemotherapeutic drugs, is being performed more frequently in non-hospital settings.

Another possible source of drug exposure sometimes occurs upon removal of the needle from the rubber stopper in the drug vial. It is sometimes possible for a small amount of the drug to exit the stopper through the opening caused by the withdrawn needle, as the needle is withdrawn. This is so even though the rubber stoppers are resilient and thought to be resealing. This situation is more likely to occur when larger gauge needles are employed to reconstitute the drug.

SUMMARY OF THE INVENTION

The device of the present invention solves this problem by minimizing or eliminating exposure of drugs to hospital personnel or other operators. The reconstitution device of the present invention allows for mounting the device over the mouth of a drug vial in a tight fit so as to minimize or eliminate the danger of inadvertent disconnection of the device from the vial. It is intended that the emptied drug vial be discarded with the reconstitution device of the present invention still attached thereto. In other words, it is intended that the drug vial and reconstitution device not be disconnected after the device is mounted on the vial.

The present invention is also directed to a reconstitution device which enables a tight fit with drug vials of varying dimensions.

The reconstitution device of the present invention includes a plastic sheath which is mounted about the mouth of a drug vial. The sheath includes a substantially circular base and a skirt depending from the base. The skirt includes a free end opposite the base, a substantially cylindrical inner surface and an outer surface.

A plurality of inwardly projecting bumps is intermittently spaced about the inner surface. The bumps are all disposed a substantially equal distance from the base. The distance between the base and the projecting bumps is substantially equal to the width of the malleable band, such as the aluminum retaining band typically found on drug vials of standard construction in the medical industry. These metal bands are used to retain the rubber stopper in the drug vial.

The reconstitution device of the invention further includes means for entering the drug vial, means for entering the interior of a second container such as a flexible plastic parenteral solution container. Examples of such containers are sold under the trademarks VIA-FLEX ® and MINI-BAG TM by Travenol Laboratories of Deerfield, Ill. In addition, flow path means are included in the reconstitution device for placing the interiors of the drug vial and second container in open communication. In the preferred embodiment, the vial entering means and second container entering means, as well as the flow path means, comprise a single, hollow, double-pointed needle which is secured between its two ends to the plastic base. The double-pointed needle extends through the base. One portion of the needle is disposed substantially at the axis of the cylinder defined by the sheath. The pointed end is recessed from the free end of the sheath skirt. The other portion of the needle extends past the other side of the base and in a preferred embodiment is surrounded by a continuous cylindrical side wall of known construction, used as a guide for piercing the injection site of the second container and also for enabling a friction fit between the reconstitution device and the second container.

In the preferred embodiment, at least the skirt, and therefore typically the entire housing of the device, is semi-flexible. Within this specification, semi-flexible means the material retains its shape at least before it is mounted on a drug vial and yet is flexible enough to be deformed between an operator's fingers or by the mouth of a drug vial.

The bumps in the reconstitution device of the present invention create a stop against the under side of the malleable band, making difficult any inadvertent disconnection of the device and the vial. The reconstitution device of the present invention may be used on various size drug vials, which although typically of a fairly standard construction within the industry, have somewhat varying dimensions. In the preferred embodiment the fit is tight enough that the bumps deform the side wall of the malleable band during installation. The flexibility of the sheath appears to increase the range of sizes of drug vials with which the reconstitution device may be successfully employed.

The present invention is directed to a reconstitution device which, although including internally projecting bumps, is flexible enough to permit molding without a complicated mold core, such that the sheath may be removed from the mold by flexing the sheath and the bumps outwardly about the mold steel.

DESCRIPTION OF THE DRAWINGS

FIG. 4 is a plan view of the sheath end of the device.

FIG. 5A is a fragmentary top plan view of a bump, disposed on the interior surface of the skirt.

FIG. 5B is a front end view of the bump illustrated in FIG. 5A.

FIG. 5C is a cross sectional view taken at the line 5C—5C of FIG. 5A.

DETAILED DESCRIPTION OF THE PREFERRED EMBODIMENT

Referring generally to FIGS. 1 through 5C, there is illustrated the preferred embodiment of the reconstitution device of the present invention.

Figure 1:
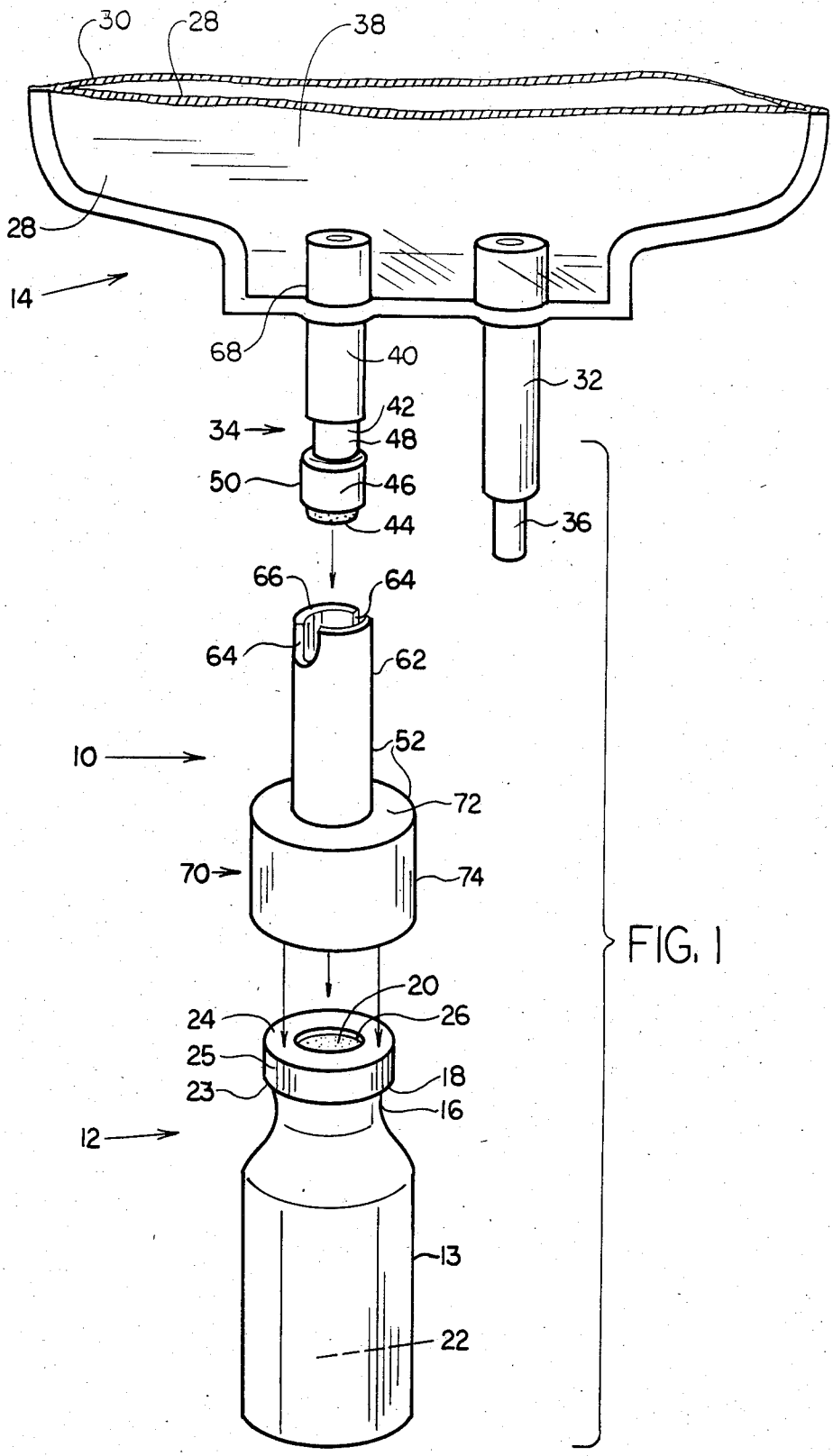
FIG. 1 is an exploded perspective view of the preferred embodiment of the invention, illustrating attachment of the reconstitution device to a drug vial and to a flexible walled parenteral solution container.

FIG. 1 illustrates a reconstitution device 10 to be mounted upon a drug vial 12 and a second container 14 such as a flexible-walled medical liquid container for parenteral liquids. The drug vial 12 contains a drug (not shown) which may be for example in powdered form or liquid form.

The drug vial 12 may be of standard construction as used throughout the medical industry. The drug vial 12 is typically made of optically transparent glass, and includes a body 13, a neck 16 and a mouth 18. A rubber or other resilient stopper 20 is mounted within the vial mouth 18. The rubber stopper 20 serves as an access site into the interior chamber 22 of the vial.

A drug vial 12 of standard construction includes an aluminum or other metal malleable band 24 mounted about the outer perimeter of the mouth 18 and the stopper 20, thereby retaining the stopper 20 within the vial.

Typically, the malleable band 24 initially includes a top portion (not shown) covering the top of the rubber stopper 20. The top portion is separated from the metal band 24 by means of a weakened score line disposed at the inner circle 26 of the metal band 24. The top portion is removed to provide access to the rubber stopper 20, such as illustrated in FIG. 1.

The second container 14, as illustrated in FIG. 1 is a flexible walled, compressible medical parenteral solution container of known construction, including two sheets 28, 30 of flexible plastic material sealed together about their peripheries. The liquid container 14 includes an administration port 32 and an injection site 34, both forming part of the container 14. In the illustrated container 14, the administration port 32 includes a plastic tube 36 with a membrane (not shown) therein which closes off the administration port 32. Typically, a spike of a standard intravenous administration set (not shown) is inserted into the tube 36, piercing the membrane and allowing liquid 38 such as dextrose solution, saline solution, water or other fluid in the container 14 to exit the liquid container 14, flow through the administration set and, via vein access means, flow into the intravenous system of a patient.

The injection site 34 includes an outer tube 40 secured between the two plastic sheets. An inner tube 42 having a membrane (not shown) closing the passage of the inner tube 42 is mounted in and sealed to the outer tube 40. A portion of the inner tube 42 extends out of the outer tube 40.

The injection site 34 typically includes a polyisoprene or latex situs 44 which is pierceable by a needle and resealable upon withdrawal of the needle. The situs includes an outer portion 46 which grips the outer surface 48 of the inner tube 42. The situs 44 may be secured to the inner tube 42 by means of a transparent shrink band 50 conforming to the outer surface 48 of the inner tube 42 and to the outer portion 46 of the situs 44.

Figure 2:
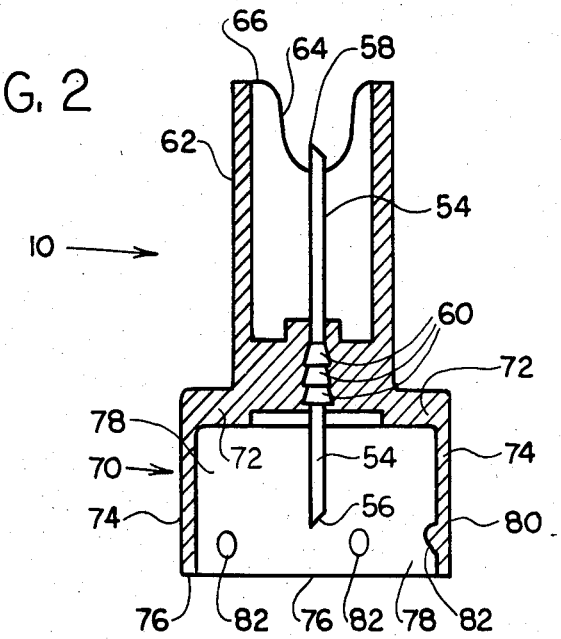
FIG. 2 is a cross sectional view of the reconstitution device of the invention.

Referring to FIGS. 1 and 2, the reconstitution device 10 includes a plastic housing 52 in which is mounted a rigid, hollow double-pointed needle 54. In the preferred embodiment the needle 54 is made of stainless steel. The needle 54 includes a sharp, vial-piercing pointed end 56 and a bag-piercing pointed end 58 opposite thereto. The needle 54 is mounted within the plastic housing 52 between the ends of the needle. In the preferred embodiment the needle 54 includes a series of annular barbs 60 to ensure that the needle is captured within the housing 52.

The housing 52 includes a substantially cylindrical second container wall 62 disposed around and spaced from the needle 54. The wall 62 may have two indentations 64 at the distal end 66 of the wall 62 which, depending upon the sizing of the reconstitution device and the second container 14 may be important in sliding over both sheets 28, 30 at the proximal end 68 of the injection site 34. Even when the indentations 64 are not so employed, they facilitate easy viewing of the pointed needle end 58 to enable proper mounting of the end 58 within the central portion of the situs 44.

The needle construction, the wall 62 and the indentions 64 are known and are included for example in product code No. 2B8064 sold by Travenol Laboratories. Upon piercing of the injection situs 44 by the needle end 58, the wall 62 may be adapted for snugly fitting around the outer portion 46 of the situs 44 as well as the outer tube 40, creating a friction fit which may be disconnected but which tends to keep the needle within the situs 44.

The reconstitution device 10 further includes a sheath 70 extending in the direction opposite the cylindrical wall 62. The sheath 70 includes a substantially circular base 72. The needle 54 is mounted generally within the base 72. The sheath includes a skirt 74 depending from the base 72. The skirt 74 includes an open, free end 76, a substantially cylindrical inner surface 78 and an outer surface 80.

A portion of the needle 54, including the needle end 56, is disposed within the cylindrical volume defined by the skirt 74. The needle end 56 is recessed from the free end 76 of the skirt 74.

In the preferred embodiment, the needle 54 embodies means for entering the drug vial through the tip 56, means for entering the interior of the second container 14, through the pointed end 58, and flow path means for placing the interiors of the drug vial and the second container in open communication. Other entering means and flow path means are within the scope of the present invention but it has been found that the preferred embodiment is of simple construction and easy to manufacture.

Figure 3:
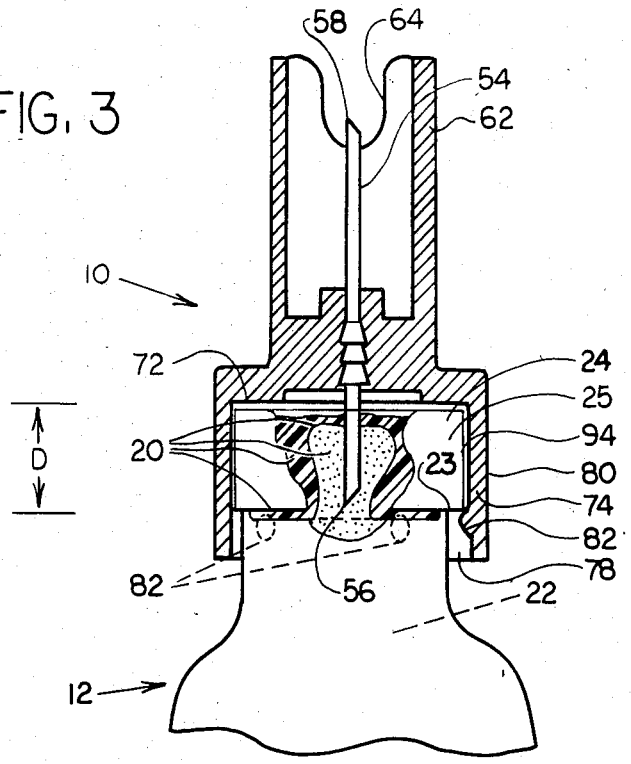
FIG. 3 is a cross sectional view of the reconstitution device attached to a drug vial.

The sheath 70 further includes a plurality of inwardly projecting bumps 82 intermittently spaced about the inner surface 78 of the skirt 74. The bumps 82 are all disposed a substantially equal distance from the base 72. This distance, noted by the letter "D" in FIG. 3, is substantially equal to the width of the malleable band 24 on the drug vial.

Referring to FIGS. 4 and 5A through 5C, there are five bumps 82 in the reconstitution device 10 of the preferred embodiments. These bumps 82 are spaced equidistant radially about the inner surface 78 of the skirt 74. Thus, in the preferred embodiment an angle defined by two adjacent bumps 82 and the axis of the needle 54 is about seventy-two degrees. In the preferred embodiment, each bump 82 includes a more narrow tip 84 facing the free end 76 of the skirt 74. The bump 82 widens from a dimension of about 0.040 inch at the tip 84 to a maximum width of about 0.080 inch. Each bump includes a sloped side 86 facing the free end 76. The sloped side 86 may be clearly seen in the cross-sectional view of FIG. 5C. The sloped side 86 extends to a point of maximum internal projection 88 which in the preferred embodiment is at least about 0.026 inch from the inner surface 78. Each bump 82 slopes rather sharply down from the point of maximum internal projection 88 to the base end 90 of the bump.

The sloped side 86 defines an angle of about 30 degrees from the inner surface 78. Furthermore, as best seen in FIG. 5B, each sloped side 86 defines a convex surface 92 across the width of the bump 82.

In the preferred embodiment, the housing 52, or at least the skirt 70 thereof is semi-flexible. For example, the skirt 70 and indeed the entire housing 52 may be made from a polyester material including a rubber modifier, to which is added a mold release agent. Samples of the device 10 have been made using HYTREL ®, sold by E. I. Du Pont de Nemours and Company, which is believed to be a polyester having a rubber modifier therein. This material gives the skirt 70 great flexibility. This is important because it enables relatively inexpensive injection molding of the housing 52 without the use of a complicated multi-piece mold core within the volume defined by the skirt 70. Instead, because of the flexible material, the housing 52 may be drawn out of the mold and mold core after manufacture, the skirt expanding and the bumps 82 flexing over the mold steel in order to enable withdrawal of the housing 52. This flexibility of the sheath 70 has an additional advantage, as will be discussed below concerning operation of the device 10.

The sheath 70 and the remainder of the housing 52 may be formed of other materials, such as polypropylene. However, with more rigid plastic structures a more complicated mold construction is made necessary in order to remove the mold core from the obstructions created by the internally projecting bumps 82.

Referring to FIG. 3, the reconstitution device 10 is installed on a drug vial 12 of standard construction by simply pushing the needle end 56 through the stopper 20. The internal diameter of the skirt 74 is sized to approximate the outer diameters defined by metal bands 24 used on most drug vials of standard construction, but drug vial dimensions vary througout the industry. A tight fit is however ensured by the bumps 82, which create a stop against the underside 23 of the malleable band 24, making difficult the inadvertent disconnection of the device 10 and the vial 12.

The fit between the skirt 74 and the vial 12 is tight enough such that in most instances the bumps 82 deform the sidewall 25 of the malleable band 24, creating vertical grooves 94 in the sidewall 25 as the skirt 74 is pushed down about the mouth 18 of the vial. If the sidewall 25 of the band 24 is wider than average, there may be no space between the top of the band 24 and the base 72 of the sheath 70. The width of the sidewall 25 may actually equal or even slightly exceed the distance "D" between the base 72 and the rear end 90 of the bumps 82. In situations with a wider sidewall 25, the bumps 82 deform the underside 23 of the malleable band 24 by causing indentations where the bumps 82 contact the underside 23.

It is believed that the skirt 74 need not be semi-flexible; however, it is believed that the semi-flexible quality does assist in creating a tight fit between the reconstitution device 10 and a wider range of sizes of drug vials 12.

While various features of the preferred embodiment have been described in detail herein and shown in the accompanying drawings, it will be evident that various further modifications are possible without departing from the scope of the invention.

What is claimed is:

1. A device for reconstituting a drug in a drug vial, the vial having a mouth with a malleable band thereabout, said device comprising:

A. a sheath including:

(i) a substantially circular base, (ii) a semi-flexible skirt depending from said base, said skirt including a free end, a substantially cylindrical inner surface and an outer surface and (iii) a plurality of inwardly projecting bumps intermittently spaced about said inner surface, said bumps all being disposed a substantially equal distance from said base, said distance being substantially equal to the width of the malleable band, (iv) wherein each of said bumps includes a sloped side facing said free end;

B. means for entering the drug vial, mounted to said base and disposed within the cylindrical volume defined by said skirt;

C. means for entering the interior of a second container, connected to said base; and D. flow path means for placing the interiors of the drug vial and the second container in open communication;

E. whereby upon installation of said sheath about the mouth of the drug vial, said bumps deform the sidewall of the malleable band and create a stop against the underside of the malleable band, making difficult the inadvertent disconnection of said device and the vial.

2. The device as in claim 1, wherein said means for entering the drug vial and a portion of said flow path means comprises a rigid, hollow, pointed needle mounted in said base.

3. The device as in claim 1, wherein said means for entering the second container and a portion of the flow path means comprises a rigid, hollow, pointed needle connected to said base.

4. The device as in claim 1, wherein said vial entering means, said second container entering means and said flow path means comprise a rigid, hollow needle having two pointed ends, said needle being secured between said ends to said base.

5. The device as in claim 1, wherein the second container is a parenteral solution container having an injection site.

6. The device as in claim 5, further comprising means for securing the device to the second container, about the injection site thereof.

7. The device as in claim 1, wherein at least said skirt comprises a polypropylene material.

8. The device as in claim 1, wherein at least said skirt comprises polyester material including a rubber modifier.

9. The device as in claim 8, wherein said skirt further comprises a material including a mold release agent.

10. The device as in claim 1, comprising at least three of said bumps.

11. The device as in claim 1, comprising five of said bumps.

12. The device as in claim 1, wherein each of said bumps includes a tip facing said free end and is wider at a point of maximum internal projection than at said tip.

13. The device as in claim 1, wherein said sloped side is at an angle of about 30 degrees from said inner surface.

14. The device as in claim 1, wherein each of said sloped sides defines a convex surface across the width of said bump.

* * * * *